United States Patent [19]

Carlyon

[11] Patent Number: 5,017,931

[45] Date of Patent: May 21, 1991

[54] INTERLEAVED CENTER AND EDGE-FED COMB ARRAYS

[75] Inventor: William R. Carlyon, Maple Grove, Minn.

[73] Assignee: Honeywell Inc., Minneapolis, Minn.

[21] Appl. No.: 292,024

[22] Filed: Dec. 15, 1988

[51] Int. Cl.[5] ..... H01Q 21/08

[52] U.S. Cl. ..... 33/700 MS; 343/824

[58] Field of Search ..... 343/700 MS File, 705, 343/708, 812, 813, 824, 827

[56] References Cited

U.S. PATENT DOCUMENTS 2,217,321 10/1940 Runge et al. ..... 343/824
4,063,245 12/1977 James et al. ..... 33/700
4,180,818 12/1979 Schwartz et al. ..... 343/705
4,475,107 10/1984 Makimoto et al. ..... 343/700
4,691,206 9/1987 Shapter et al. ..... 343/700

FOREIGN PATENT DOCUMENTS 2161652 1/1986 United Kingdom ..... 343/700

*Primary Examiner*—Theodore M. Blum
*Attorney, Agent, or Firm*—Thomas J. Nikolai; Roger W. Jensen

[57] ABSTRACT

A microstrip antenna array for use at millimeter wave frequencies for radiating and receiving a broadside beam of energy in which a first symmetric edge-fed array has its radiating elements physically interleaved with the radiating elements of a center-fed array. Using this configuration, the antenna performance remains relatively stable over both temperature and frequency.

5 Claims, 3 Drawing Sheets

INTERLEAVED CENTER AND EDGE-FED COMB ARRAYS

BACKGROUND OF THE INVENTION

I. Field of the Invention

This invention relates generally to the design of microstrip antenna arrays for transmitting and receiving millimeter wave signals, and more particularly to a microstrip antenna system incorporating physically interleaved, but electrically independent broadside antenna arrays which are relatively stable in performance irrespective of variations in temperature and frequency.

II. Discussion of the Prior Art

As is pointed in applicant's co-pending application Ser. No. 172,461, filed Mar. 24, 1988, entitled "INTERLEAVED PRINTED CIRCUIT ARRAY ANTENNAS", various missile tracking and electronic countermeasure systems, as well as target-seeking weapons, employ radar and radiometric devices in which millimeter wave signals are sent and received via microstrip antenna arrays. Specifically, that application describes how two independent microstrip antenna arrays may be interleaved to occupy substantially the same physical space. In applicant's earlier arrangement, each of the two interleaved antenna arrays is edge fed from a single edge only. It is found that with shifts in temperature and/or in the transmitter frequency, the main beams of the two antennas tend to move in opposite directions of each other so as to no longer exhibit true broadside antenna characteristics. This is due to the fact that the transmission lines carrying the radiator elements act as travelling wave devices. A problem thus presents itself on just how to design a microstrip broadside antenna structure for millimeter wave applications in which a sending and receiving array can be interleaved but which will still exhibit a stable performance with variations in temperature and frequency.

It is accordingly a principal object of the present invention to solve the foregoing problem, i.e., to provide an antenna structure which is stable over frequency and temperature. I have discovered that by feeding a symmetric array of transmission line radiators in its center, the variation in main beam position over frequency and temperature of each half of the array can be made to cancel the variation induced in the other half of the array. Thus, such a center-fed array exhibits a stable main beam position over frequency and temperature. This suggests that a center feed is a desirable configuration, but because of space limitations, it is extremely difficult to physically interleave two center-fed arrays because the feed for each array interferes with the other. To overcome this difficulty, I have utilized a second, edge-fed array which is similar in many respects to a center-fed array but which the segments thereof are flipped so that the feedlines extend along the opposed outside edges rather than down the middle. By properly laying out the printed circuit masks used to create the microstrip antenna transmission lines and radiators, the spacing between transmission lines and radiators can by such that the two antenna arrays can be interleaved without physical interference (overlap) of the conductive patterns.

SUMMARY OF THE INVENTION

In accordance with the general principles of this invention, there is provided a microstrip antenna for millimeter wave transmitting and receiving systems which comprises a center-fed array of parallel, spaced-apart microstrip transmission lines, each having a plurality of radiating elements conductively joined thereto along with an edge-fed array of parallel, spaced-apart microstrip transmission lines, each again having a plurality of radiating elements joined thereto and with the transmission lines and radiating elements comprising the first array being interleaved with the transmission lines and radiating elements comprising the second array. The resulting structure thus provides two interleaved antennas, generally occupying the same physical space or volume and allowing a separate transmit and receive function, yielding improved isolation as well as stability regardless of temperature and frequency variations. That is to say, the main beam maintains its perpendicular (broadside) orientation relative to the antenna substrate in spite of changes in temperature and/or transmitting frequency.

DESCRIPTION OF THE DRAWINGS

The foregoing features and advantages of the present invention will become apparent to those skilled in the art from the following detailed description of a preferred embodiment, especially when considered in conjunction with the accompanying drawings in which.

DESCRIPTION OF THE PREFERRED EMBODIMENT

Figure 1:
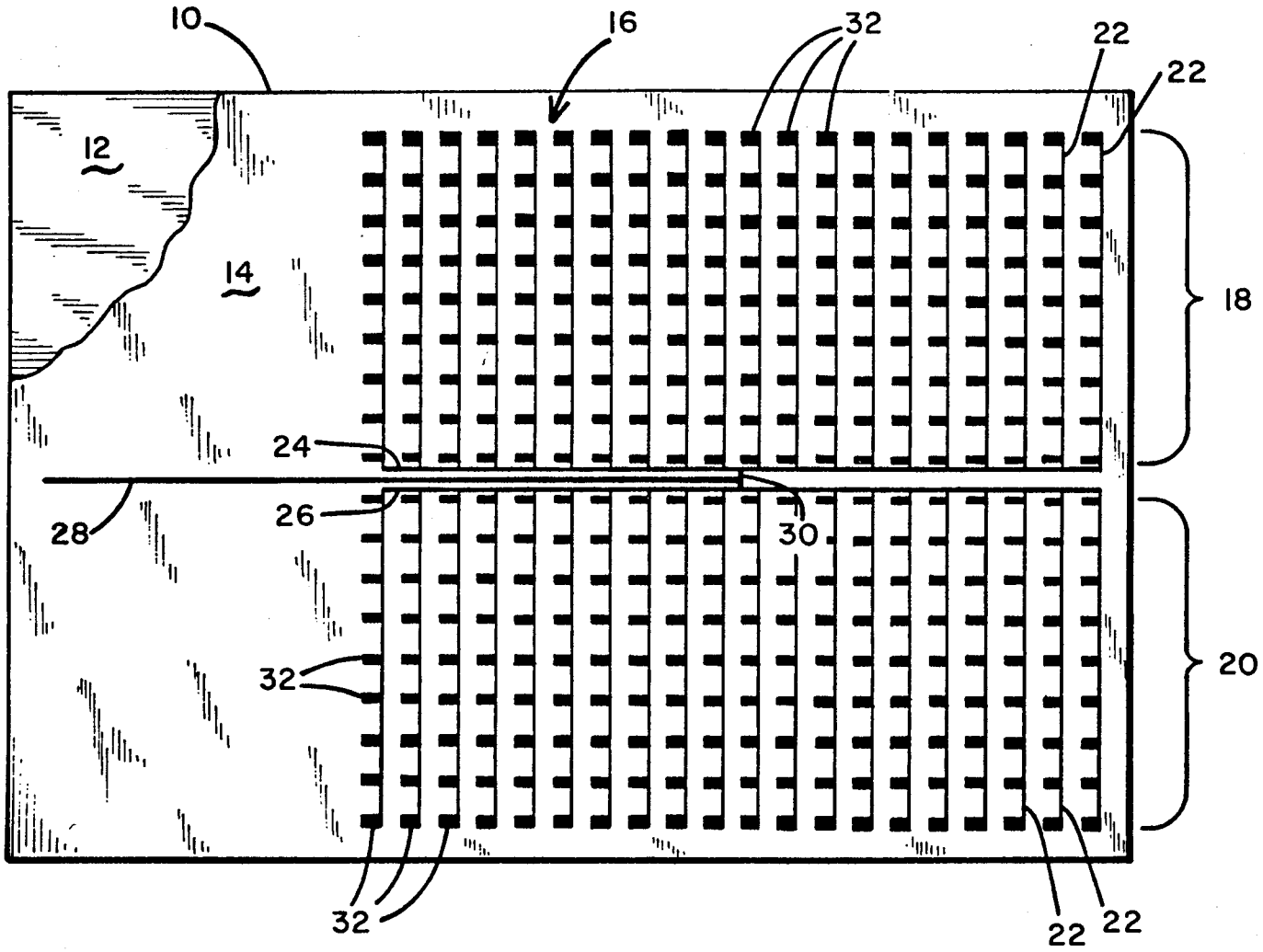
FIG. 1 illustrates a typical, prior art center-fed microstrip antenna array.

Referring to FIG. 1, there is shown a microstrip antenna comprising an insulating substrate 10 having a conductive ground plane 12 adhered to the undersurface thereof and a pattern of etched printed circuitry on the obverse, major surface 14 of the substrate. The pattern is indicated generally by numeral 16 and is seen to include a first array encompassed by brackets 18 and a second array encompassed by brackets 20, each including a plurality of parallel transmission lines 22. All of the transmission lines in the array 18 are conductively joined to a transversely extending feedline 24. Similarly, all of the transmission lines 22 in the second array 20 are electrically joined to a transversely extending conductive feedline 26. As can be seen in FIG. 1, sufficient space is provided between the feedlines 24 and 26 so that a further 50 ohm feedline 28 may extend therebetween to a Tee junction 30 where the energy is split and delivered to both of the array halves 18 and 20. From there, the energy is again split by another pair of Tee junctions disposed in the center of each of the feedlines 24 and 26. Thus, the entire array 16 can be considered as comprised of four quarter arrays partitioned at the location of the Tee junction 30.

Each of the parallel transmission lines 2 has associated with it a plurality of radiating elements, here shown as comb radiators 32. Each of the rows of comb radiators in the array halves 18 and 20 are identical. The phase of the radiated energy from each comb is adjusted to point the peak of the sum beam from all combs is in the desired direction by appropriately designing the distance between each comb radiator element. The magnitude of the radiated power of each comb is then adjusted to control the pattern of the sum of the radiated energy by adjusting the width of each comb radiator.

Once the rows of comb radiators are designed, the feedlines 24, 26 and 28 are designed by using the rows as a radiation load on the feedlines and then adjusting the spacing between the rows of transmission lines 22 so that the peak of the radiated energy from each quarter array points in the desired direction. In FIG. 1, each quarter array is seen to include ten parallel transmission lines 22, each having nine radiating elements 32 associated therewith. It should be understood, however, that a greater or lesser number of transmission lines and/or radiators per transmission line may be utilized, it being preferred, however, that the array be symmetrical in all four quadrants.

Figure 2:
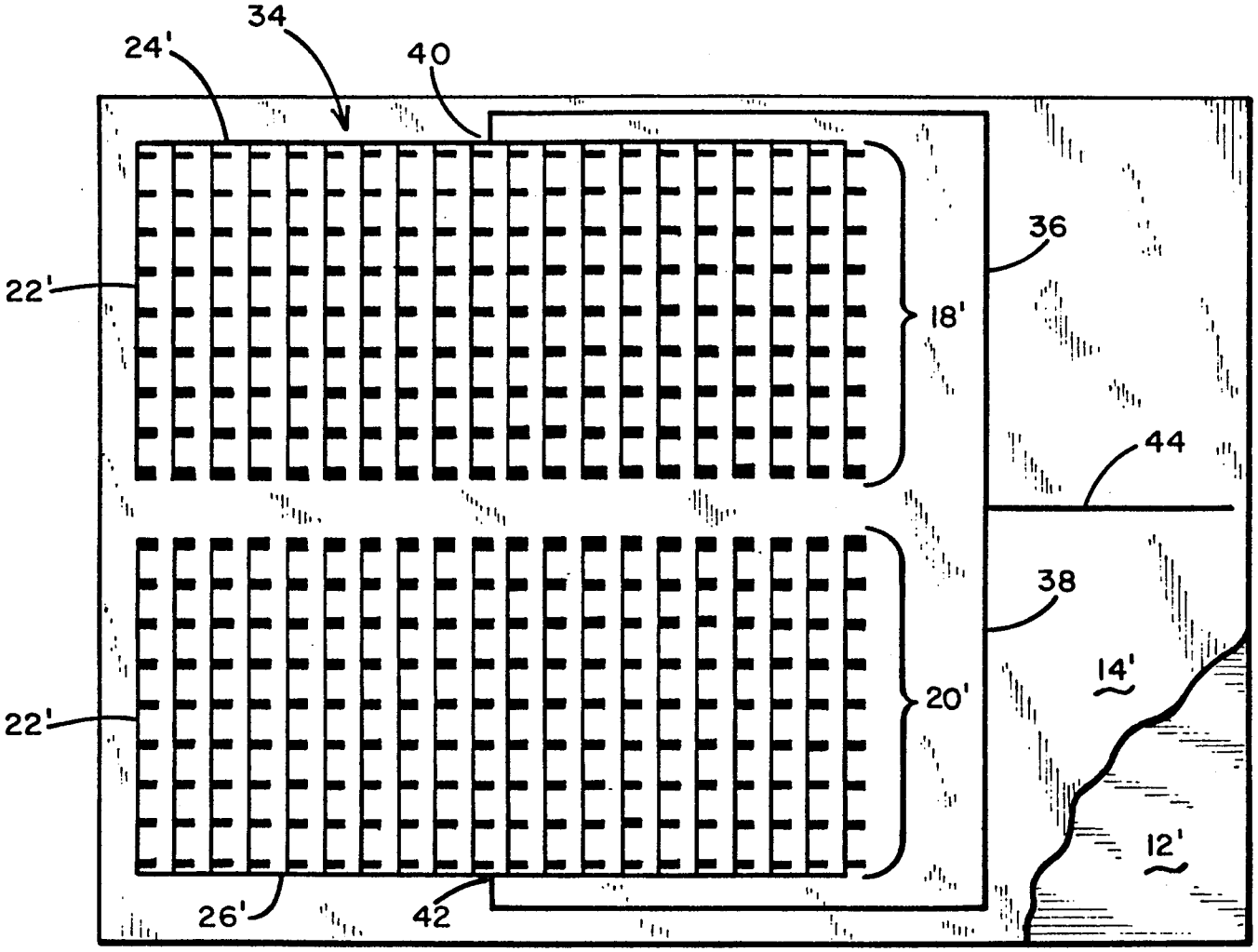
FIG. 2 comprises an edge-fed array in accordance with the present invention.

Referring next to FIG. 2, there is indicated generally by numeral 34 a microstrip edge-fed array useful in transmitting or receiving electromagnetic energy in a broadside fashion when operating at millimeter wave frequencies. The edge-fed comb array is fed in the center of both outside edges, resulting in an energy distribution which is symmetric about the center of the antenna array. The energy is then coupled to each of the radiating elements and radiated into free space. Topologically, the printed circuit pattern is quite similar to that shown in FIG. 1 except the four quarter arrays are flipped so that the feedlines 24' and 26' are along the outside edges of the array halves 18' and 20' instead of between them as in the center-fed array of FIG. 1. Further feedline means including bifurcated branches 36 and 38 are conductively joined to the feedlines 24' and 26' by Tee junctions 40 and 42, respectively. These two branches are bilaterally symmetrical and are bisected by a further conductive feedline 44 to which a transmitter or a receiver may be connected.

Figure 3:
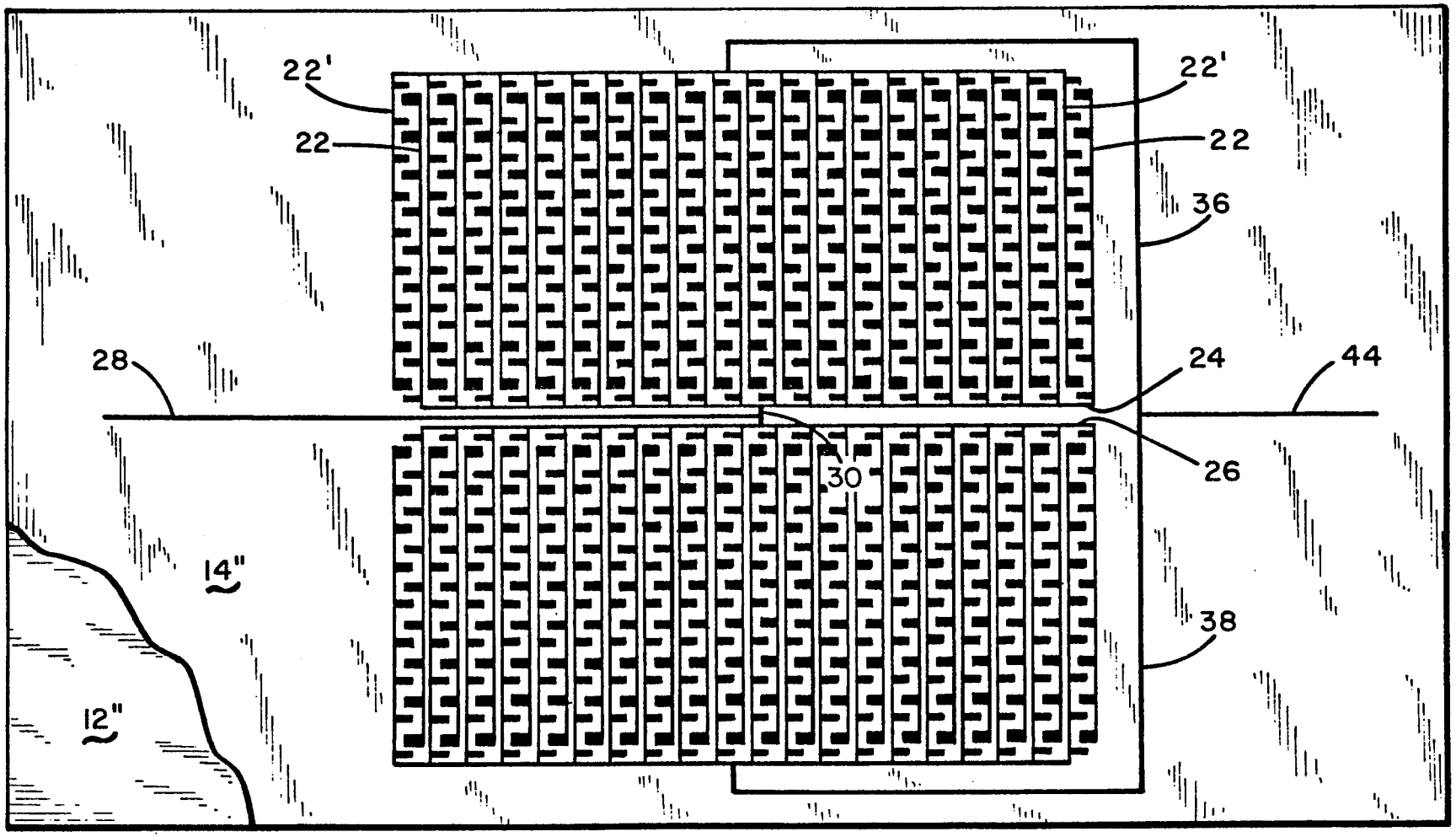
FIG. 3 illustrates the manner in which the arrays of FIGS. 1 and 2 may be physically interleaved.

Referring next to FIG. 3, it depicts the manner in which a center-fed array of the type illustrated in FIG. 1 and an edge-fed array illustrated in FIG. 2 can be physically interleaved so as to occupy substantially the same physical space. The interleaved microstrip antenna again comprises an insulating (dielectric) substrate 14'' having a conductive sheet 2'' adhered to the undersurface thereof to function as a ground plane and on the obverse surface is the interleaved, etched, center-fed and edge-fed arrays. The feedlines 24, 26 and 28 and the Tee junction 30 of the center-fed array fall into the gap or space between the array halves 18' and 20' of the edge-fed antenna structure while the bifurcated feedlines 36 and 38 partially surround the interleaved array on the exterior thereof.

While FIG. 3 depicts a square array, it is only for the purpose of illustrating the principles of the present invention. In practice, the array can be figured so as to include arcuate edge feedlines, thus providing a circular pattern.

In use, the interleaved array of FIG. 3 when operating in a transmitting mode produces a main beam which emanates perpendicular to the surface of the substrate 14'', i.e., broadside. Because of the symmetrical nature of the array, and the manner in which the arrays are fed, the beam does not vary in direction as a function of changes in frequency or temperature.

To achieve uniform power distribution across the interleaved array, it is found expedient to vary the width of the comb radiating elements in such a way that the radiators are thinner at the point of connection to the feedlines than they are at the opposite end of the transmission line. Thus, at the point where the energy is expected to be the greatest, the radiating elements are designed to radiate lesser energy than at a point further down the transmission line from the energy source. In this fashion, equality can be maintained between the energy radiated into free space from all of the radiating elements in the array.

Tests performed upon the antenna array of FIG. 3 have established that the performance thereof remains stable irrespective of dimensional changes caused by large temperature swings. Moreover, modest changes in the frequency of the millimeter wave signals driving the array does not result in major shifts in the output level of the main beam or the side lobes.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A microstrip antenna for millimeter wave transmitting and receiving systems, comprising in combination:

(a) a center-fed two-dimensional array of parallel, spaced-apart microstrip transmission lines, each having a plurality of radiating elements conductively joined thereto; and (b) an edge-fed two-dimensional array of parallel, spaced-apart microstrip transmission lines, each having a plurality of radiating elements joined thereto, the transmission lines and radiating elements comprising said edge-fed array being interleaved with said transmission lines and radiating elements comprising said center-fed array.

2. The microstrip antenna as in claim 1 wherein said radiating elements are comb elements.

3. A microstrip antenna for millimeter wave transmitting and receiving systems, comprising in combination:

(a) a planar dielectric sheet having a conductive ground plane adhered to one major surface thereof and a pattern of printed conductors on the other major surface, said pattern including:

(i) first and second arrays of parallel transmission lines, said arrays being spaced apart from one another with the transmission lines in the first array longitudinally aligned with transmission lines in the second array, (ii) a plurality of radiating elements conductively joined to each of said transmission lines in said first and second arrays along the lengths thereof and at regular intervals, (iii) a first feedline conductively joined to a first end of all of said transmission lines in said first array and a second feedline conductively joined to a first end of all of said transmission lines in said second array, said first and second feedlines being on opposed outer edges of said first and second arrays, (iv) further feedlines joining the mid-points of said first and second feedlines to a common port without intersecting said first and second arrays, (v) third and fourth arrays of parallel transmission lines, said third and fourth arrays being spaced apart from one another with the transmission lines in said third array longitudinally aligned with the transmission lines in said fourth array, (vi) a plurality of radiating elements conductively joined to each of said transmission lines in said third and fourth arrays along the lengths thereof and at regular intervals, (vii) a third feedline conductively joined to a first end of all of said transmission lines in said third array and a fourth feedline conductively joined to a first end of all of said transmission lines in said fourth array, said third and fourth feedlines being on adjacent inner edges of said third and fourth arrays, and (viii) further feedlines extending in the space between said third and fourth arrays and coupled to the mid-points of said third and fourth feedlines, said transmission lines and radiating elements in said first and second arrays being interleaved with the transmission lines and radiating elements in said third and fourth arrays.

4. The microstrip antenna as in claim 7 wherein said further feedlines associated with said first and second arrays and said further feedlines associated with said third and fourth arrays respectively joined to a signal transmitter and a signal receiver.

5. The microstrip antenna as in claim 7 wherein said radiating elements are comb radiators.

* * * * *

UNITED STATES PATENT AND TRADEMARK OFFICE

CERTIFICATE OF CORRECTION

PATENT NO. : 5,017,931

DATED : May 21, 1991

INVENTOR(S) : Carlyon, William R.

It is certified that error appears in the above-identified patent and that said Letters Patent is hereby corrected as shown below:

Column 6, Line 8 (Claim 4), delete the number "7" and replace it with -- 3 --.

Column 6, Line 13 (Claim 5), delete the number "7" and replace it with -- 3 --.

Signed and Sealed this

Fifteenth Day of September, 1992

*Attest:*

DOUGLAS B. COMER

*Attesting Officer*

*Acting Commissioner of Patents and Trademarks*